United States Patent [19]

Askevold

[11] 4,098,306

[45] Jul. 4, 1978

[54] AUTOMATIC SHUT-OFF LIQUID DISPENSING NOZZLE

[75] Inventor: Robert J. Askevold, Fullerton, Calif.

[73] Assignee: Union Oil Company of California, Los Angeles, Calif.

[21] Appl. No.: 701,568

[22] Filed: Jul. 1, 1976

[51] Int. Cl.[2] ..... B65B 57/14

[52] U.S. Cl. ..... 141/218; 141/301

[58] Field of Search ..... 141/1, 46, 52, 59, 93, 141/97, 128, 198, 206–229, 290, 291, 301, 392

[56] References Cited

U.S. PATENT DOCUMENTS

| | | | |
|---|---|---|---|
| 3,946,773 | 3/1976 | Hansel | 141/206 |
| 3,996,979 | 12/1976 | Barr et al. | 141/392 |

*Primary Examiner*—Richard E. Aegerter
*Assistant Examiner*—Frederick R. Schmidt
*Attorney, Agent, or Firm*—Gregory F. Wirzbicki; Lannas S. Henderson; Richard C. Hartman

[57] ABSTRACT

A gasoline dispensing nozzle for discharging gasoline into receiving vessels and for removing vapors therefrom through a vapor removal line is provided with an automatic shut-off device that terminates the delivery of gasoline in the event liquid gasoline flows into said vapor removal line. The shut-off device comprises a sensing orifice disposed at the end of a flexibly mounted tube within said vapor removal line, which tube leads to a passageway extending into the housing of said gasoline nozzle and terminating in a chamber that contains a conventional, diaphragm-operated, trigger mechanism for closing the main nozzle valve. In operation, no matter which way the nozzle is inserted into a gasoline tank fill pipe, the sensing orifice, by gravity, will fall to a position such that, if gasoline flows into said vapor removal line, it must also flood the sensing orifice. When gasoline enters the sensing orifice, the diaphragm-operated trigger mechanism, responding to a suction created by the flow of gasoline through a conventional venturi within the nozzle housing, releases the spring-to-close main nozzle valve.

8 Claims, 1 Drawing Figure

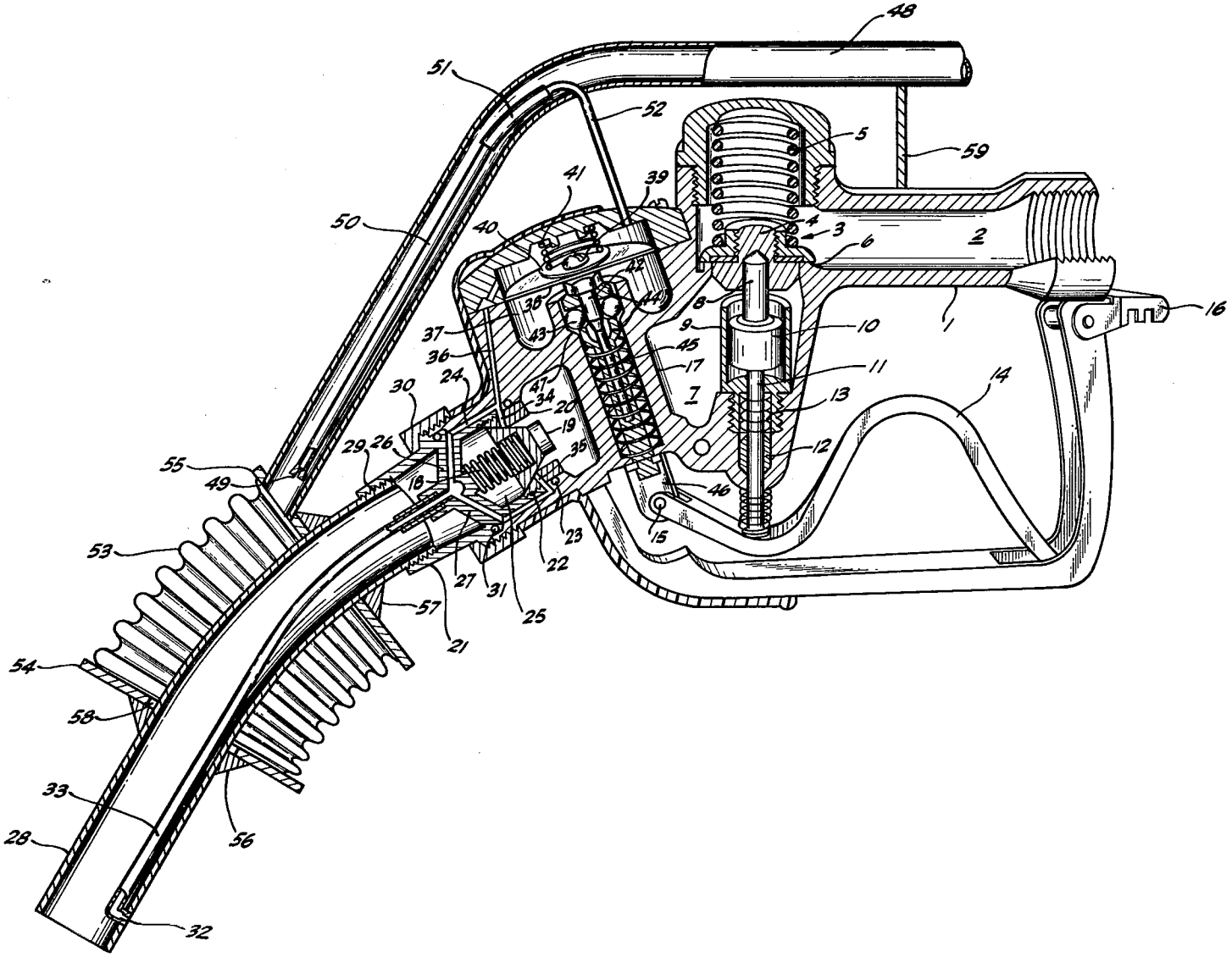

AUTOMATIC SHUT-OFF LIQUID DISPENSING NOZZLE

BACKGROUND OF THE INVENTION

1. Field of the Invention

This invention relates to gasoline dispensing nozzles having means for automatically shutting off delivery into a receiving vessel when filled, and for removing displaced vapors from said receiving vessel. The invention is particularly concerned with providing means for shutting off gasoline delivery when liquid gasoline is drawn or displaced from the receiving vessel into the vapor removal means.

2. Description of the Prior Art

Most conventional gasoline dispensing nozzles have automatic shut-off devices incorporated therewith for terminating the flow of gasoline into a receiving vessel when it has been filled. Such devices normally comprise an orifice situated in the nozzle spout and a venturi within the nozzle housing, both of which lead by suitable passageways to the same portion of a chamber divided by a diaphragm. Until the receiving vessel is filled, air is simply drawn through the orifice and aspirated into the gasoline flowing through the venturi. But when the receiving vessel is filled, the orifice becomes flooded with gasoline and air can no longer be aspirated in this manner. Hence, the flow of gasoline through the venturi creates a suction which forces the diaphragm to move a sufficient distance to activate a trigger mechanism, such as that shown in U.S. Pat. No. 2,582,195, for releasing the spring-to-close main valve within the nozzle housing.

In addition to automatic shut-off devices, many gasoline dispensing nozzles are equipped with means to remove vapors generated in the receiving vessel during the filling thereof. Generally, such nozzles are designed to remove vapors by sealing the entrance of the gasoline tank fill pipe from the atmosphere so that vapors may be displaced, or induced under a slight negative pressure of about 1–2 inches of water, through an annular opening surrounding the nozzle spout into a vapor removal line. However, because some modern gasoline tank fill pipes are substantially horizontal near the opening, it is possible to insert the nozzle into the fill pipe such that the nozzle spout is tipped slightly upwardly. Since the sensing orifice is usually located at the end of the nozzle spout, it will thus be held at an elevation slightly higher than the lowest portion of the annular entrance to the vapor removal line. Hence, after rising up the fill pipe, liquid gasoline will be drawn or displaced into the vapor removalline without concomitantly flooding the sensing orifice that activates the automatic shut-off device.

This problem is even more acute when it is necessary to turn the nozzle sideways or even upside down to fill the gasoline tank. In such unnatural positions, the sensing orifice may be an inch higher in elevation than the lowest portion of the annular entrance to the vapor removal line. Hence, again, gasoline would be pumped into the vapor removal line to the vapor recovery facilities without ever triggering the automatic shut-off device.

SUMMARY OF THE INVENTION

Briefly, such problems are avoided in the present invention by providing a gasoline dispensing nozzle with a second sensing orifice located within the vapor removal line associated with said dispensing nozzle. Like the sensing orifice in the nozzle spout, this orifice leads by a suitable gas communication passageway to the upper portion of a chamber divided by a diaphragm for operating a conventional trigger mechanism that releases the spring-to-close main nozzle valve. As is conventional, another gas communication passageway leads from the upper portion of the chamber to the throat of a venturi, through which the gasoline being delivered into the receiving tank must pass. Thus, when either of the two sensing orifices becomes filled with liquid gasoline, the pressure within the upper portion of the chamber will be reduced by the suction action of the venturi. And provided the diaphragm is designed to lift a sufficient distance to activate the trigger mechanism when either of the orifices is filled, the main nozzle valve will automatically close.

To insure that the gasoline entering the vapor removal line will always contact the orifice contained therein, it is preferred that said orifice be disposed at the end of a flexibly mounted rigid tube within said vapor removal line, said tube forming part of the gas communication passageway leading from the orifice to the diaphragm-containing chamber. Hence, in operation, no matter which way the nozzle is inserted into the gasoline tank fill-pipe, the sensing orifice will seek by gravity a position such that, if gasoline is drawn or displaced through said vapor removal line, it must also flood the sensing orifice.

DETAILED DESCRIPTION OF THE INVENTION

The drawing shows, by lengthwise section of a gasoline dispensing nozzle having vapor recovery means associated therewith, a preferred embodiment of the apparatus of this invention. Located in the vapor removal line 48 is shown a sensing orifice 49 which is disposed at the end of a metal tube 50, which in turn is flexibly connected by silicone rubber tubing 51 to another metal tube 52 leading to chamber 37. Passageway 36 and annular vacuum passageway 24 connect chamber 37 with the throat openings 34 and 35 of a venturi through which the dispensing gasoline must flow. Thus, if liquid gasoline should enter the vapor removal line 48, and hence also orifice 49, the pressure within the upper portion of chamber 37 will be reduced by the suction action of the venturi, thereby lifting diaphragm 38 and activating a trigger mechanism for releasing the spring-to-close main valve 3.

To describe the invention with more particularity, there is shown in the drawing a gasoline dispensing nozzle comprising a housing 1 with inlet conduit 2 leading to a main valve generally indicated at 3. Main valve 3 consists of a valve disk 4, which is urged by spring 5 to seat against valve seat 6, thereby preventing the passage of gasoline into passageway 7. Valve stem 8 of main valve 3 extends downwardly and connects in dash pot cylinder 9 to a piston 10, which in turn is connected by a rod 11 that extends downwardly and outwardly of housing 1 through a packing gland 12 maintained in position by spring 13. Rod 11 is disposed to be engaged by operating lever 14 so that, when said lever 14 is manually forced upwardly about pivot 15 to engage latch device 16, valve disk 4 will lift against the compression of spring 5 and gasoline will flow into passageway 7.

Gasoline passing into passageway 7 surrounds the external walls of cylindrical member 17 containing a trigger mechanism to be described in more detail hereinafter. Assuming the gasoline in passageway 7 is sufficiently pressurized, it will overcome the resistance of spring 18 anchored on a boss of poppet valve body 21 to force poppet valve disk 19 to disengage from seat ring 20, which seat ring 20 is both threaded into poppet valve body 21 at 22 and provided with an O-ring 23 to prevent the passage of gasoline from passageway 7 into annular vacuum passageway 24. Gasoline thus flows into chamber 25 of valve body 21, surrounds conduits 26 and 27 of said valve body 21, and discharges via spout 28 into a suitable receptable, not shown.

To prevent leakage of gasoline out of the nozzle assembly, poppet valve body 21 is threaded into spout 28 at 29 and is also engaged by means of a threaded sleeve 30 to the housing 1. In addition, an O-ring 31 surrounds valve body 21 to prevent the seepage of air into annular vacuum passageway 24.

As those skilled in this art will realize, the major purpose of the described poppet valve assembly is to produce a suction for automatically operating the shut-off trigger mechanism mounted within cylindrical member 17 in the event the receiving vessel is filled. When gasoline flows between the poppet valve disk 19 and seat ring 20, a venturi effect is created which aspirates air from orifice 32 through line 33, conduits 26 and 27, annular passageway 24, and seat ring openings 34 and 35 into the gasoline flowing between the poppet valve disk 19 and seat ring 20. So long as the air is aspirated into the flowing gasoline in the manner described, the trigger mechanism will not be activated. However, when gasoline is filled in the receptacle such that it also floods orifice 32, the suction created by the venturi can no longer be relieved with air from the atmosphere through line 33. As a result, gas pressure in line 36 leading from annular passageway 24 to the upper portion of a chamber 37 is reduced, thereby forcing diaphragm 38 to move upwardly and release operating lever 14 by activating the conventional trigger mechanism now to be described.

Diaphragm 38 is engaged by means of screw 39 and washer 40 to a compression spring 41 contained in the upper portion of chamber 37. Diaphragm 38 is also engaged by screw 39 to a locking plunger 42, which depends from the central portion of diaphragm 38. Locking plunger 42 consists of a tapered portion for releasing a plurality of balls 43 and a depending stem which serves as ball retainer. Balls 43 are contained in lateral openings of another plunger 44 which is slideably mounted in cylindrical member 17 and urged upwardly therein by spring 45. However, plunger 44 is restricted in its upward travel by the contact of connecting link 46 with housing 1.

Now, assuming that the operating lever 14 is retained in a valve-open position by latch device 16, and that no liquid has flooded orifice 32, balls 43 will rest on annular shoulder 47 and prevent plunger 44 from moving in a downward direction against spring 45 in response to a greater force urged by spring 5. However, when diaphragm 38 moves upwardly in response to the flooding of orifice 32, locking plunger 42 will lift a sufficient distance such that balls 43 will roll radially inwardly and contact the depending stem of said locking plunger 42, thereby releasing plunger 44 for downward movement. Once free, plunger 44 will be forced downwardly by spring 5 acting on rod 11, while the latched end of said lever 14 will swing momentarily upwardly from latch device 16. Once free of latch device 16, operating lever 14 will come to rest in the position shown in the drawing. Simultaneously therewith, spring 45 will force plunger 44 back into the locked position, spring 5 will close valve 3, and spring 41 will push diaphragm 38 into its original position.

To prevent the escape of gasoline vapors during the filling of a receiving vessel, vapor collecting means, such as flexible rubber bellows member 53, commonly called a boot, is provided to surround spout 28. Boot 53 is of sufficient resiliency such that, when the nozzle is not in use, circular plates 54 and 55 will seat against truncated, conical rings 56 and 57, respectively; but when the dispensing nozzle is inserted into a gasoline tank fill pipe or the like, plate 54 slides retractably away from ring 56 and rests in vapor-tight engagement with the gasoline tank fill pipe. In this position vapors evolved in the gasoline tank pass through annular space 58 into the interior of boot 53 and from thence to vapor recovery facilities, not shown, via tubular vapor removal line 48, which is connected to housing 1 by support 59. Vapors may be withdrawn through vapor removal line 48 by simple displacement or under a slight negative pressure generated by a conventional vacuum pump, not shown, which pump can be connected to the free end of line 48 by a suitable hose.

Situated within said vapor removal line 48 is a metal tube 52 that leads from the upper portion of chamber 37 to the central portion of said vapor removal line 48. A short section of silicone rubber tubing 51 flexibly connects tube 52 with a straight section of metal tubing 50 terminating in orifice 49. This orifice 49 is preferably of the same cross-sectional area as orifice 32 so that, when either is filled with liquid, diaphragm 38 will always rise the same distance against spring 41 in response to the same reduced gas pressure in chamber 37 created by the venturi. (A preferred diameter for both orifices, assuming they are circular, is 1/16 inch when the venturi is designed to draw gases into the flowing gasoline stream under a vacuum of about 30 inches of water.) However, even if the orifices are of unequal cross-sectional areas, the automatic shut-off as described will prove operable, provided diaphragm 38 is designed to lift a sufficient distance to activate the trigger mechanism when the orifice of smaller cross-sectional area is filled.

Thus, because tube 50 is flexibly mounted, it will now be seen that, regardless of which way the nozzle is inserted into the fill spout of a receiving vessel, the orifice end of tube 50 will fall to a position within vapor removal line 48 such that a liquid passing through said line 48 must also flood orifice 49 (provided, of course, that said line 48 is tubular in construction, or otherwise designed so that only frictional forces can interfere with the gravitation of said orifice end to its lowest possible elevation in said line 48).

While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A liquid dispensing nozzle comprising:

(a) a body having an inlet port, a discharge port, and a liquid communication passageway housed within said body connecting said inlet port and said discharge port;

(b) a valve within said body for controlling the flow of liquid through said liquid communication passageway;

(c) operating means for opening and closing said valve;

(d) a venturi, situated within said liquid communication passageway, said venturi having a throat opening thereinto for the aspiration of gases into a liquid passing through said liquid communication passageway;

(e) vapor transporting means comprising:

(1) means, mounted on said body, for collecting vapors displaced from a receiving vessel during the filling thereof with liquid passing through said discharge port; and (2) a vapor removal line connected at one end in vapor-tight engagement with said vapor collecting means and adapted at the other end to be connected to means for removing vapors transported through said vapor removal line;

(f) a gas communication passageway connecting said venturi throat opening with a first and second orifice through which gases are drawn into said gas communication passageway when liquid is passing through said discharge port, said first orifice being disposed adjacent to said discharge port so that gases in said gas communication passageway are in communication with fluids surrounding said discharge port, and said second orifice being disposed in said vapor transporting means such that said gas communication passageway is in fluid communication with said vapor transporting means; and (g) means for activating said operating means to close said valve when either of said orifices is filled with liquid, said activating means comprising (1) a chamber, housed within said body of said nozzle, which chamber is divided by a pressure responsive diaphragm into a first and second chamber, said first chamber being a portion of said gas communication passageway, and (2) means, attached to said diaphragm, for closing said valve in response to the flexing of said diaphragm into said first chamber when a reduced pressure, caused by the suction produced by said venturi when liquid passes therethrough and either of said orifices is filled with liquid, is present in said first chamber.

2. A nozzle as defined in claim 1 wherein said first and second orifices are of the same cross-sectional area.

3. A nozzle as defined in claim 2 wherein said first and second orifices are circular.

4. A nozzle as defined in claim 1 wherein said first and second orifices are circular.

5. A nozzle as defined in claim 1 wherein said second orifice is disposed in said vapor removal line.

6. A nozzle as defined in claim 5 wherein said first and second orifices are of the same cross-sectional area.

7. A nozzle as defined in claim 6 wherein said first and second orifices are circular.

8. A nozzle as defined in claim 5 wherein said first and second orifices are circular.

* * * * *